US006929570B2

(12) United States Patent
Forman III

(10) Patent No.: US 6,929,570 B2
(45) Date of Patent: Aug. 16, 2005

(54) APPARATUSES AND METHODS FOR A NET-SUSPENDED TARGET

(75) Inventor: John Hall Forman III, East Greenwich, RI (US)

(73) Assignee: RI Blast, Inc., East Greenwich, RI (US)

( * ) Notice: Subject to any disclaimer, the term of this patent is extended or adjusted under 35 U.S.C. 154(b) by 0 days.

(21) Appl. No.: 10/680,887

(22) Filed: Oct. 8, 2003

(65) Prior Publication Data

US 2005/0079934 A1 Apr. 14, 2005

(51) Int. Cl.[7] ..... A63B 69/00; A63B 61/00

(52) U.S. Cl. ..... 473/462; 473/476; 473/494; 473/459

(58) Field of Search ..... 473/459, 476, 473/478–480, 485, 487, 494, 465, 469–472; 273/348, 354, 371, 378, 381, 382, 398, 401, 273/402, 407, 317, 317.3

(56) References Cited

U.S. PATENT DOCUMENTS 4,871,178 A * 10/1989 Diaz ..... 473/471
5,064,195 A * 11/1991 McMahan et al. ..... 473/480
5,470,056 A * 11/1995 Dennesen ..... 473/462
5,472,212 A * 12/1995 Bercaw ..... 473/462
5,813,928 A * 9/1998 Hsieh ..... 473/480
6,582,329 B1 * 6/2003 Cabrera ..... 473/480
2002/0107092 A1 * 8/2002 Gottlieb-Myers et al. ... 473/479

OTHER PUBLICATIONS http://www.excelsportsproducts.com/catch_it.htm, retrieved Sep. 2, 2003.

* cited by examiner

*Primary Examiner*—Raleigh W. Chiu
(74) *Attorney, Agent, or Firm*—PELOQUIN, PLLC; Mark S. Peloquin, Esq.

(57) ABSTRACT

An apparatus includes a surface configured to enclose a first volume having an adjustable upper opening and a lower opening. The surface is coupled to a frame and both the surface and the frame are removably attachable to a court net; thereby presenting a target to a player, such that an object can be aimed by the player to enter the upper opening and pass through the lower opening. An alarm can be included to signal the presence of the object within the first volume.

35 Claims, 11 Drawing Sheets

APPARATUSES AND METHODS FOR A NET-SUSPENDED TARGET

BACKGROUND OF THE INVENTION

1. Field of Invention

The invention relates generally to practice and drills directed to improve athletic performance, and more specifically to apparatuses and methods used to train ball-control skills during volleyball practice.

2. Art Background

Achieving perfection in any sport requires diligent practice requiring a player to repeat a move or play many times before the required level of speed, accuracy, and consistency has been achieved. In order to obtain the focused practice needed to improve the player's level of performance specific drills are created and overseen by a coach.

In the game of volleyball, the skills of serving, passing, blocking, defense, setting, and spiking require diligent practice to raise an individual player's level of performance or a team's ability to interact as a coherent whole. An existing, wheeled, floor standing "target" has been directed to the volleyball need. Such a floor standing target is currently sold by Excel Sports Products under the name "Catch It™." Existing devices such as the Catch It™ provide an obstruction on the court floor due to the nature of the floor standing design. The mechanically rigid nature of the floor standing target presents a hazard to players moving quickly about the volleyball court floor. Human contact with such a structure can result in injury to the player with a subsequent loss of play time.

Additional problems presented by a floor standing unit are the requirements for a large amount of storage space in which to store the target after training has ended and a lack of visibility across the court due to the structure required to support the target off of the court floor. The existing Catch It™ target also lacks an adjustable target area. An adjustable target area is desirable and would allow players having a range of skills to use the target while allowing the best players to become even better by aiming for an increasingly small target area.

The existing targets designed for volleyball are also not very usable for other sports that are played on a court floor with a court net dividing the court, such as badminton or tennis.

What is needed is a light weight, portable, storable, adjustable target for practicing skills related to games played on courts with court nets.

BRIEF DESCRIPTION OF THE DRAWINGS

The invention may best be understood by referring to the following description and accompanying drawings that are used to illustrate embodiments of the invention. The invention is illustrated by way of example in the embodiments and is not limited in the figures of the accompanying drawings, in which like references indicate similar elements.

DETAILED DESCRIPTION

In the following detailed description of embodiments of the invention, reference is made to the accompanying drawings in which like references indicate similar elements, and in which is shown by way of illustration, specific embodiments in which the invention may be practiced. These embodiments are described in sufficient detail to enable those of ordinary skill in the art to practice the invention. In other instances, well-known circuits, structures, and techniques have not been shown in detail in order not to obscure the understanding of this description. The following detailed description is, therefore, not to be taken in a limiting sense, and the scope of the invention is defined only by the appended claims.

Apparatuses and methods are described to provide a light weight net-suspended target for use during training for sports utilizing court nets such as, but not limited to, volleyball, tennis, and badminton.

Figure 1A:
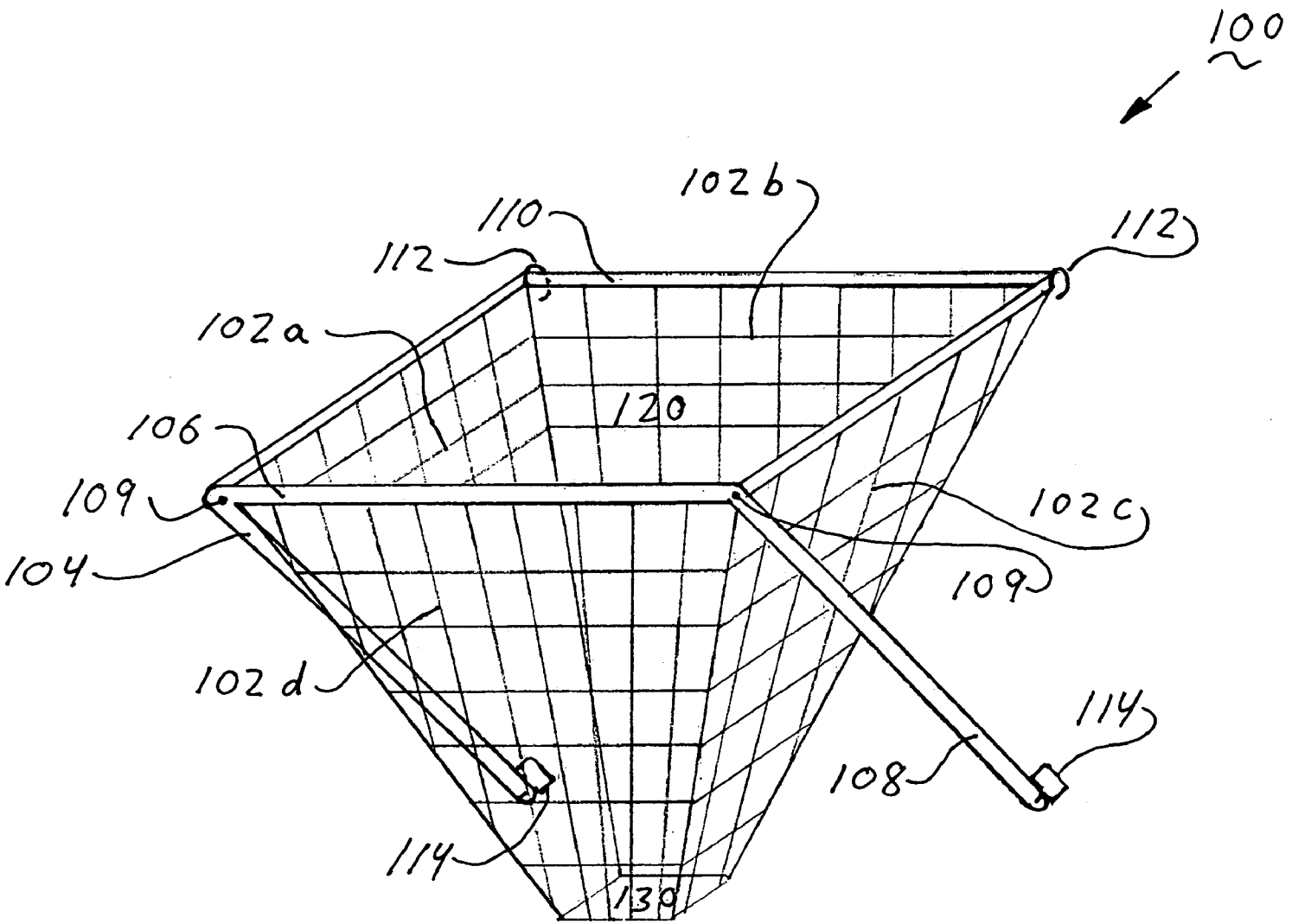
FIG. 1A illustrates a net-suspended target, according to one embodiment of the invention.

FIG. 1A illustrates a net-suspended target, according to one embodiment of the invention. With reference to FIG. 1A, a net suspended target is shown generally at 100. Target 100 includes a surface of general shape having a plurality of sides indicated by 102*a*, 102*b*, 102*c*, and 102*d*. In other embodiments the surface is defined by other sides. The surface 102 can be made out of a variety of materials such as woven net material, cloth, plastic, etc. The surface can be made out of an almost limitless number of different materials; the present invention is not limited by the choice of materials used for the surface; however, it has been found that desirable performance is obtained by using light weight materials that do not unduly weight, and thereby deform, the court net. The surface is enclosed, as shown in FIG. 1A, and forms a volume having a top edge indicated by 110 which defines an upper opening 120 in the volume. Upper opening 120 is the "target area" that a player aims an object at when the net-suspended target is in use. A lower opening in the volume functions as an exit for the object and is indicated at 130.

In several of the figures described herein, the surface will be depicted with mesh lines which can represent netting.

Due to the difficulty of illustrating isometric views of a three dimensional structure made out of netting, at times in the illustrations, only the portion of the surface closest to the viewing position will be rendered and the corresponding hidden mesh lines will not be indicated in order to preserve the clarity of the view. At other times, for example in FIG. 1A, FIG. 1B, and FIG. 4 only the perimeter outline (corners) of the hidden portion of the surface is shown. Similarly, in FIG. 4, FIG. 5, and FIG. 6 the portion of the mesh of a court net 410 directly behind the target is not shown to preserve clarity in the illustration. Those of ordinary skill in the art will appreciate and understand these modifications to the figures as described herein.

The surface is removably attachable to a court net (shown below in conjunction with FIG. 4) with hooks 112. Other structures can be used in place of hooks 112, for example, clips, loops of material; loops or flaps of material with a snap closure or a hook and loop closure such as a VELCRO® brand hook and loop closure, and a sleeve are but a small list of the structures that can be used to removably attach the surface to the court net. A court net will be illustrated below in conjunction with FIG. 4, FIG. 5, and FIG. 6.

Figure 1B:
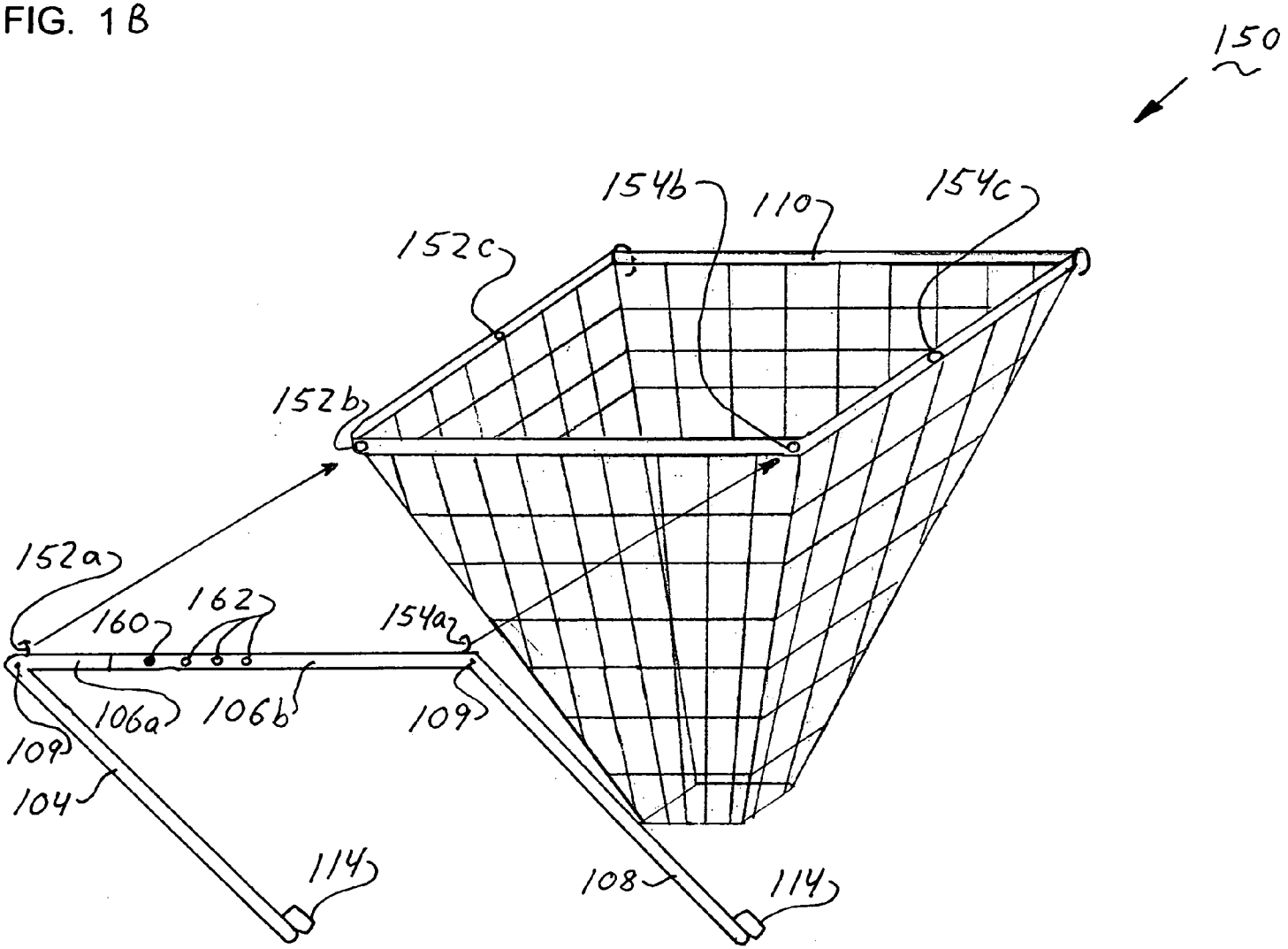
FIG. 1B illustrates an exploded view of a net-suspended target depicting a surface and a frame, according to one embodiment of the invention.

With reference back to FIG. 1A, a frame is shown at 104, 106, and 108 and is removably attachable to the surface (as described more fully in conjunction with FIG. 1B). The lower end of frame 104 is removably attachable to the court net with clip 114. A box clip can be used for clip 114 as well as many other kinds of attachment hardware, such as clips, slots, etc. The present invention is not limited by the means used to attach frame 104 to the court net. For example, a lace can be used to provide a releasable means of attachment as well as a plastic "tie wrap." In a similar way, frame 108 is removably attachable to the court net by clip 114 or other releasable attachment means. Hinges 109 facilitate folding frame 104 and frame 108 parallel with frame 106. By folding the frame in on itself the net-suspended target can be folded and rolled up, capturing the surface if deformable; thereby collapsing and reducing the volume of the net-suspended target which is useful for storing when the target is not in use.

FIG. 1B illustrates an exploded view of the net-suspended target depicting a surface and a frame with an adjustable upper opening, according to one embodiment of the invention. With reference to FIG. 1B, top edge 110 includes openings, 152*b*, and 154*b* which can be looped over hooks 152*a* and 154*a* respectively, to facilitate coupling the frame to the top edge of the surface 110. In one embodiment, the frame 106 (FIG. 1A) can be made out of two telescoping members 106*a* and 106*b* (FIG. 1B). The telescoping members can be cylindrical in cross-section but need not be constrained to a cylindrical cross-section. In an embodiment utilizing a cylindrical cross-section, the outside diameter of 106*a* is sized to fit within the inside diameter of 106*b*; the sections (106*a* and 106*b*) can be locked in place with a pushbutton or a friction locking mechanism. A pushbutton locking mechanism is illustrated by a series of through holes 162 located in 106*b*. A pushbutton is located within section 106*a* and is shown locking the sections together at position 160. Other ways of achieving an adjustable length section are possible and within the scope of variations contemplated by the teachings presented herein. Another way of achieving adjustable length is to provide a number of different frame sections of various lengths for use in frame section 106. The different length frame sections can be swapped out to achieve the cross-sectional area desired for the upper opening 120 (FIG. 1A).

In one embodiment, the depth of the upper opening is adjusted by placing opening 152*c* on hook 152*a* and by placing opening 154*c* on hook 154*a*; thereby, decreasing the cross-sectional area of the upper opening of the volume presented by the target 150. One or more of the openings 152*b*, 152*c*; 154*b*; and 154*c* can be reinforced by using a grommet or a similar structure to prevent deterioration of the surface material. Alternatively, other methods of adjusting the upper opening are contemplated, such as twistable locks, which would be used in place of hooks 152*a* and 154*a* in conjunction with a mating opening in top edge 110. In one embodiment, top edge 110 can be made from a continuous chain which can be secured to the frame at positions 152*a* and 154*a*, using hooks, clips, rings, etc.

Many other variations of the aforementioned techniques for adjusting and coupling the surface to the frame are within the scope of the teachings presented herein. The present invention is not limited to the methods and apparatuses described to couple the frame to the surface.

In one embodiment, a net-suspended target adapted for use in volleyball weighs approximately four pounds. In this embodiment, with reference to FIG. 1A, the frame (104, 106 and 108) is made of 20 gauge aluminum tube having a diameter of seven eights of an inch. The surface (102*a*, 102*b*, 102*c*, and 102*d*), enclosing the volume which comprises the target, is made of #36 Nylon netting with a 4.00 inch square mesh. The top edge of the surface 110 is made of 0.5 inch wide black Nylon and has grommets placed as shown in FIG. 1B at positions 152*b*, 152*c*, 154*b* and 154*c*. The grommets can be made of steel or brass or other suitable material. The dimensions of the upper opening are 40.0 inches by 40.0 inches. The vertical length of the surface is 42.0 inches and the size of the lower opening 130 is 18.0 inches by 18.0 inches. The hooks 152*a* and 154*a* (FIG. 1B) are 18 gauge, 0.75 inch wide and are made out of stainless steel. A construction as described in this embodiment provides the necessary transparency when used on the volleyball court. The top edge 110 can be colored to provide increased visibility. For example, red, orange, and fluorescent yellow are colors that can be used to communicate to a player where the edge of the upper opening is located. Other marking indicia can be provided on the target to assist the player, such as, adding a colored border around the lower opening and/or adding a colored stripe down along the length of the corners of the surface when the surface is configured with corners as shown in FIG. 1A through FIG. 5. In one embodiment, the upper and lower openings as well as the vertical corners of the surface are trimmed in 0.5 inch black nylon to provide a space frame appearance which assists the player while aiming at the target.

Figure 1C:
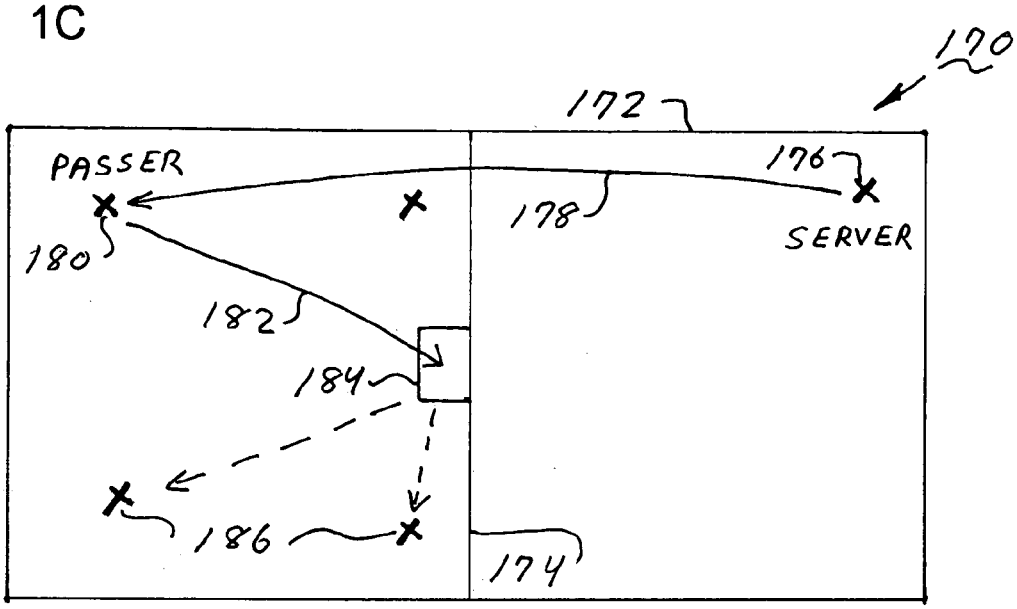
FIG. 1C depicts a net-suspended target as used on a volleyball court according to one embodiment of the invention.

FIG. 1C depicts the net-suspended target as used on a volleyball court according to one embodiment of the invention. With reference to FIG. 1C, practice with a net-suspended target on a volleyball court is shown generally at 170, including a volleyball court 172 with a court net 174. In one scenario of volleyball practice, a server 176 serves a ball to the opposite side of the court. During the serve, the trajectory of the ball is indicated at 178. A passer 180 receives the serve and passes the ball to the net-suspended target at 184, the ball follows trajectory 182 from the passer 180 to the target 184. By practicing the play previously described, the passer 180 practices precision passing to the target 184. Precision passing allows a setter, which would normally occupy the position of the target 184, to pass the ball to an attacker indicated generally at positions 186. Precision passing to the setter permits the setter to pass more precisely to an attacker, which in turn results in a more precise attack when the ball is returned to the other side of the court. Other scenarios of use are readily accommodated, such as the one described in FIG. 1D.

Figure 1D:
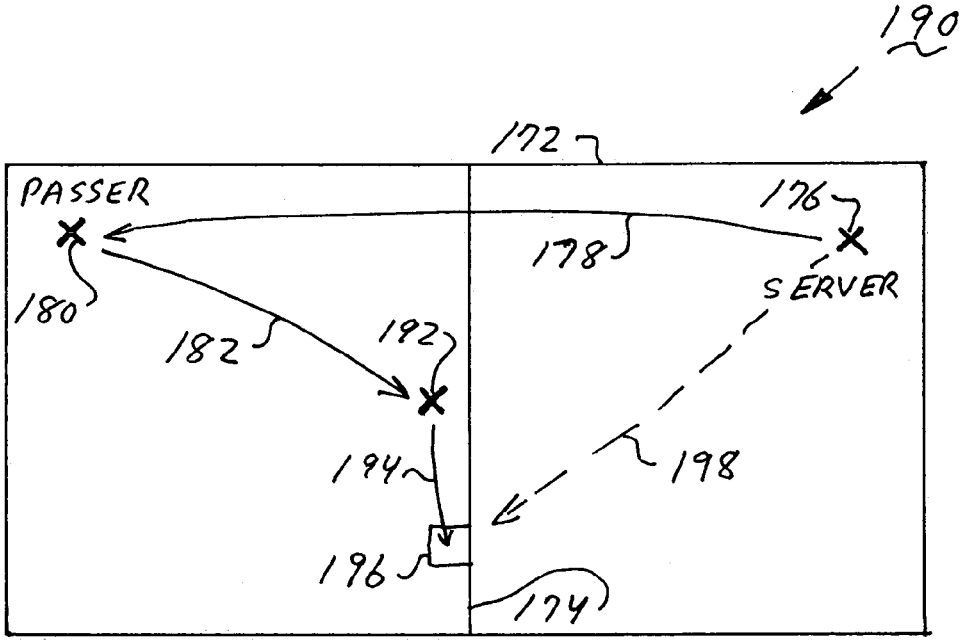
FIG. 1D illustrates another use of a net-suspended target as used during volleyball training according to one embodiment of the invention.

FIG. 1D illustrates another use of the net-suspended target as used during volleyball practice. With reference to FIG. 1D, alternative uses such as passing to an attacker and use as a serving target on the volleyball court are shown generally at 190. A server 176 serves the ball to the opposing side; the trajectory of the ball is as indicated by 178. A passer 180 receives the serve by passing to the setter 192. The setter 192 sets the ball to the net-suspended target at 196. In this scenario, the setter 192 practices precision setting to the target at 196. The trajectory of the ball during the practice pass from the setter is shown at 194.

Many other embodiments of the invention can be employed for use on a volleyball court, in one such embodiment, the server 176 can practice serving to the net-suspended target 196 by serving the ball along trajectory 198. The adjustable upper opening of the target can be used to hone the skill of the players as appropriate to the specific need of a player; decreasing the opening as the skill level improves for some players while allowing other players, of lower skill level, to use a larger opening.

It will be apparent to those of ordinary skill in the art that many other scenarios of use are possible within the teachings presented in this description. The embodiments of the invention are not limited to those descriptions of volleyball practice described herein. For example, other scenarios are possible within the context of volleyball, as well as other sports utilizing court nets. In one embodiment, multiple net-suspended targets can be mounted on the court net as appropriate for the particular play or drill being practiced. Multiple net-suspended targets can be mounted on the court net for different levels of player ability. For example, in a given drill, players of lower ability can aim for a target configured with a larger top opening and players of higher ability can aim for a target configured with a smaller top opening. In some embodiments a target can be configured as a net within a net.

Figure 2A:
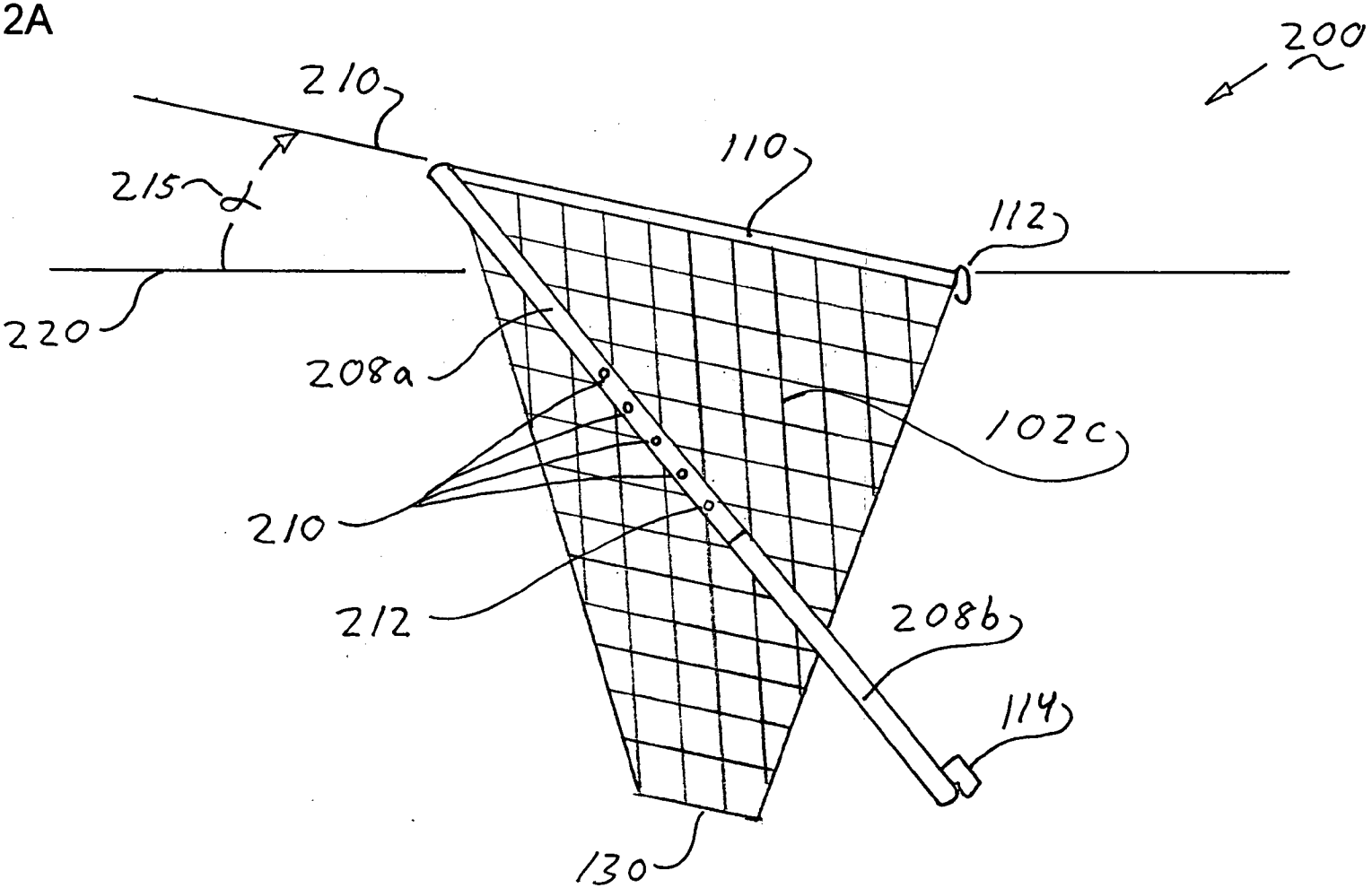
FIG. 2A illustrates a target opening angled toward the court net, according one embodiment of the invention.

FIG. 2A illustrates the target opening angled up and toward the court net, according to one embodiment of the invention. With respect to FIG. 2A, a plane passing through the upper opening is indicated by 210. An angle 215 (gamma) between a reference and the plane 210 can be adjusted by extending telescoping frame sections 208*a* and 208*b*. The reference can be a horizontal to a court floor 220, the court net or any other reference chosen to define the angle 215. In one embodiment, frame section 208*b* can slide within frame section 208*a*. A pushbutton locking mechanism is used to secure the sections in place. Frame section 208*a* has a plurality of through holes indicated by 210. Frame section 208*b* has a pushbutton 212 anchored internally which also engages one of the holes 210 in section 208*a* to lock the two sections together; thereby, creating a fixed adjustable length frame. Similarly, the length of the frame section on the other side of the target (not shown) can be adjusted, thereby permitting the angle of the plane 210 of the upper opening of the target to be varied.

In the elevated position, shown in FIG. 2A, the target can be used to receive high velocity serves originating on the opposite side of the court net, such a serve can be indicated at 198 in FIG. 1D. The serve from the opposite side of the court net can approach the target at a lower angle of attack, where the angle of attack is measured relative to the court floor similar to the way angle 215 is measured. Alternatively, when a pass approaches the target from the same side of the court net that the target is located on, such as the pass indicated by 182 in FIG. 1C, the elevated position of the plane of the upper opening 210 requires the passer to increase the angle of attack of the ball relative to the plane of the upper opening 210.

Figure 2B:
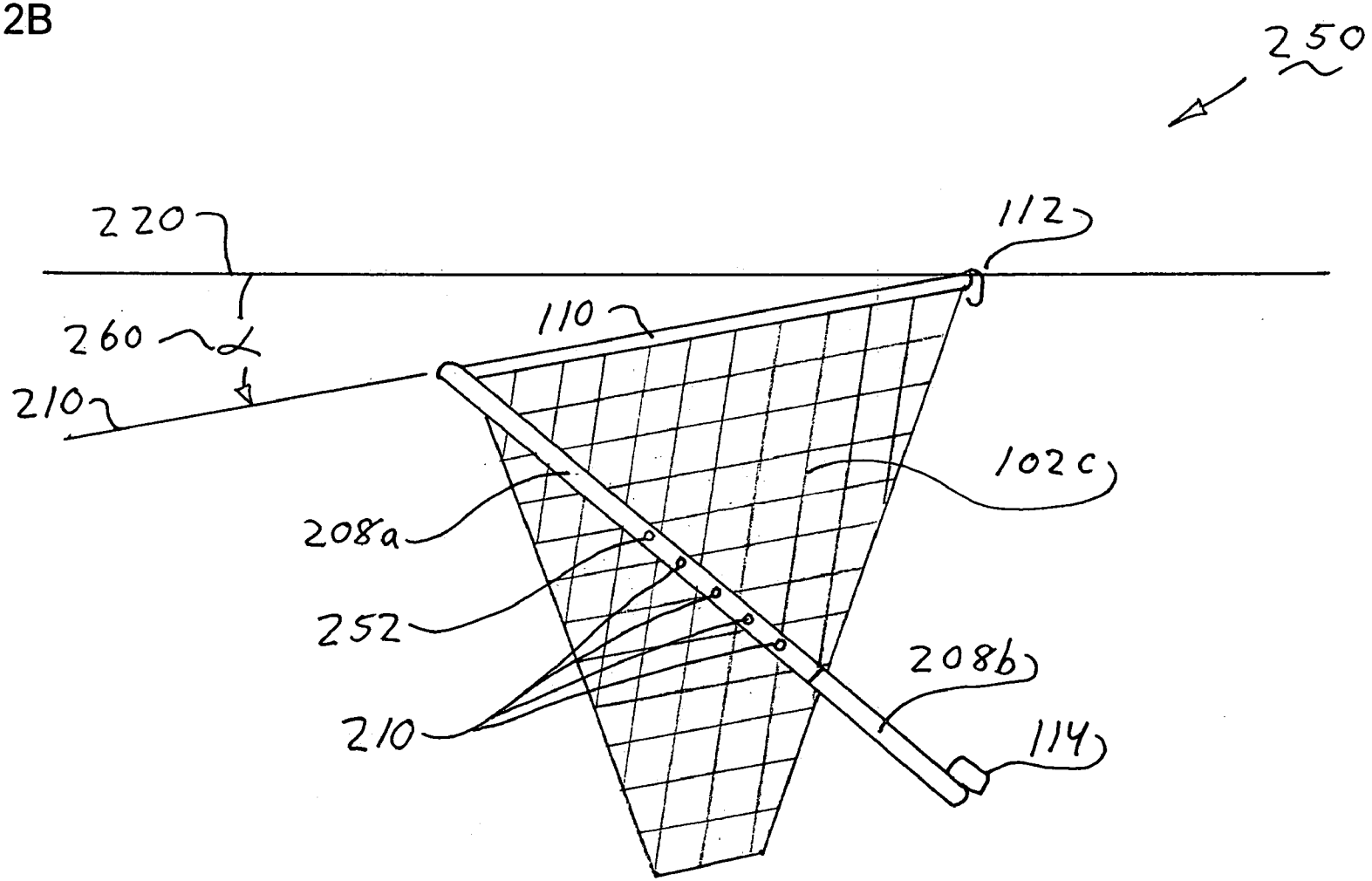
FIG. 2B illustrates a target opening angled away from the court net, according to one embodiment of the invention.

FIG. 2B illustrates at 250 the upper opening of the target angled down and away from the court net, according to one embodiment of the invention. With reference to FIG. 2B, such an orientation can be achieved by depressing the push button and closing the telescoping poles until the push button engages the hole as indicated at 252. The angle that a plane 210, passing through the upper opening of the surface, makes with a line parallel to the court floor 220 is indicted by 260. A lowered orientation, as shown at 250, can also be useful when it is desired to direct the ball to the target with a high angle of attack from the opposite side of the court net from which the target is suspended, such as shown at 198 in FIG. 1D.

Figure 2C:
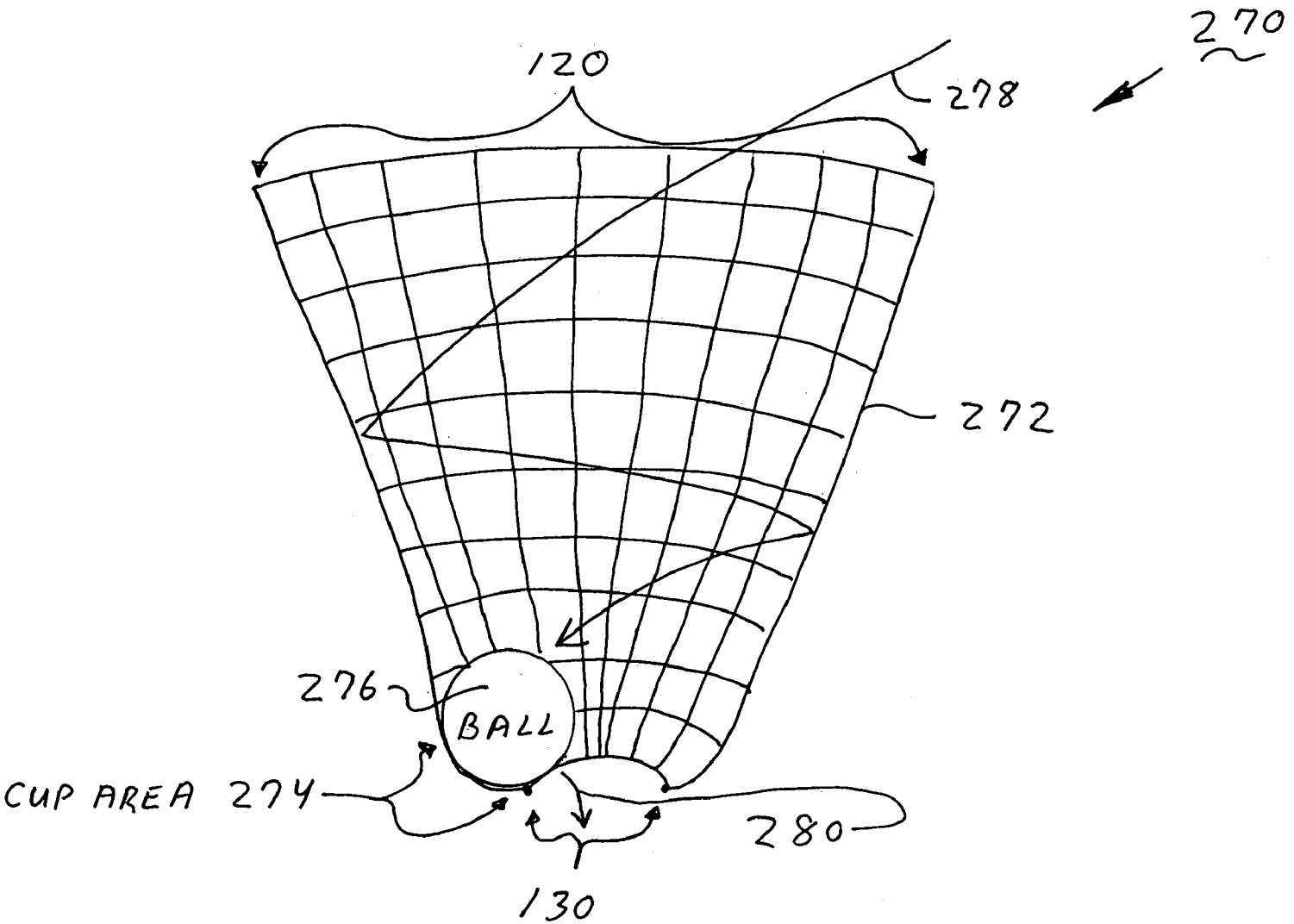
FIG. 2C shows a cup area within the surface according to one embodiment of the invention.

FIG. 2C shows a cup area within the surface according to one embodiment of the invention. With reference to FIG. 2C, a cross-sectional view of the volume enclosed by surface 272 is shown at 270. An upper opening of the volume is indicated at 120. A ball 276 passes into the volume through the upper opening 120 and eventually passes out of the lower opening 130. During the time in which the ball 276 contacts the surface 272, most of the kinetic energy of the ball (imparted during the pass) is dissipated through multiple bounces 278 within the volume, and a cup area 274 within the lower portion of the surface 272, serves to momentarily capture the ball; thereby allowing the ball to drop along a mostly vertical vector 280 from the lower opening 130. Confining the ball to drop along a mostly vertical vector results in a majority of balls falling into a catch basket (not shown) placed directly below the lower opening 130.

Alternate paths of travel are possible for the ball 276 within the volume enclosed by surface 272, such as a single contact with the surface 272 at the cup area 274. Such a single contact settles the ball and permits the ball to drop along the mostly vertical vector 280 from the lower opening 130.

Figure 3A:
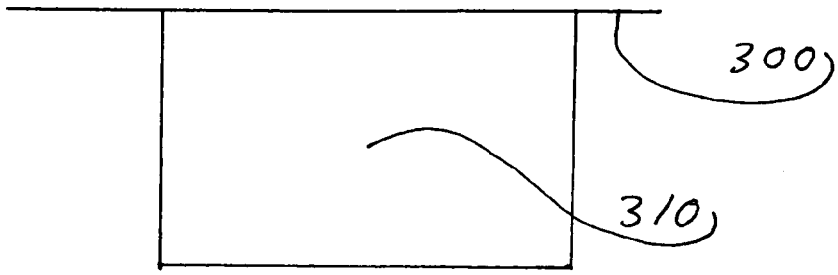
FIG. 3A illustrates a target cross-sectional area according to one embodiment of the invention.

FIGS. 3A through 3D illustrate four different amounts of cross-sectional area for the upper opening of the target according to various embodiments of the invention. In one embodiment of the invention, FIG. 3A illustrates a cross-sectional area 310 of the upper opening that can represent full extension of the frame and surface in both the width dimension (parallel to the court net 300) and a depth dimension (perpendicular to the court net 300) according to one embodiment of the invention.

Figure 3B:
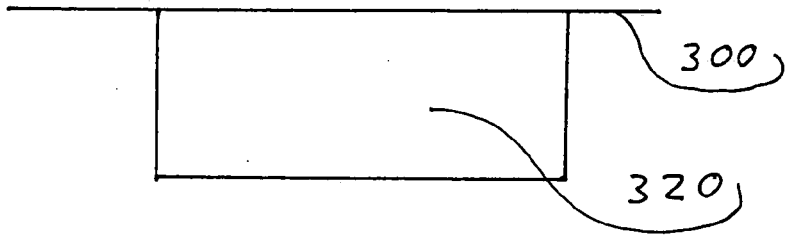
FIG. 3B illustrates a reduced target depth according to one embodiment of the invention.

FIG. 3B illustrates a reduced target depth according to one embodiment of the invention. With respect to FIG. 3B, the depth of the upper opening can be reduced by hooking openings 152*b* and 152*c* onto hook 152*a* and hooking openings 154*b* and 154*c* onto hook 154*a* as shown in FIG. 1B. With reference to FIG. 3B, the resulting reduced cross-sectional area of the upper opening is indicated as region 320.

Figure 3C:
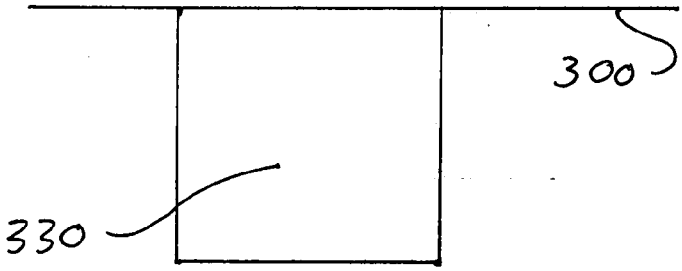
FIG. 3C illustrates a reduced target width according to one embodiment of the invention.

FIG. 3C illustrates a reduced target width according to one embodiment of the invention. With respect to FIG. 3C, a width of the upper opening can be adjusted by compressing the telescopic portion of the frame 106*a* and 106*b* described in conjunction with FIG. 1B, resulting in a reduced cross-sectional area of the upper opening as indicated at 330.

Figure 3D:
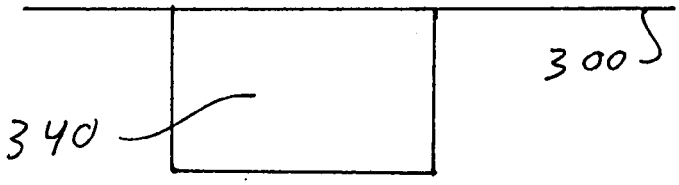
FIG. 3D illustrates a reduced target width and depth according to one embodiment of the invention.

FIG. 3D illustrates a reduced target width and depth according to one embodiment of the invention. With reference to FIG. 3D, combining the reductions in depth described above in reference to FIG. 3B and the reduction in width, described in conjunction with FIG. 3C results in a reduced cross-sectional area of the upper opening shown in, FIG. 3D at 340.

Figure 4:
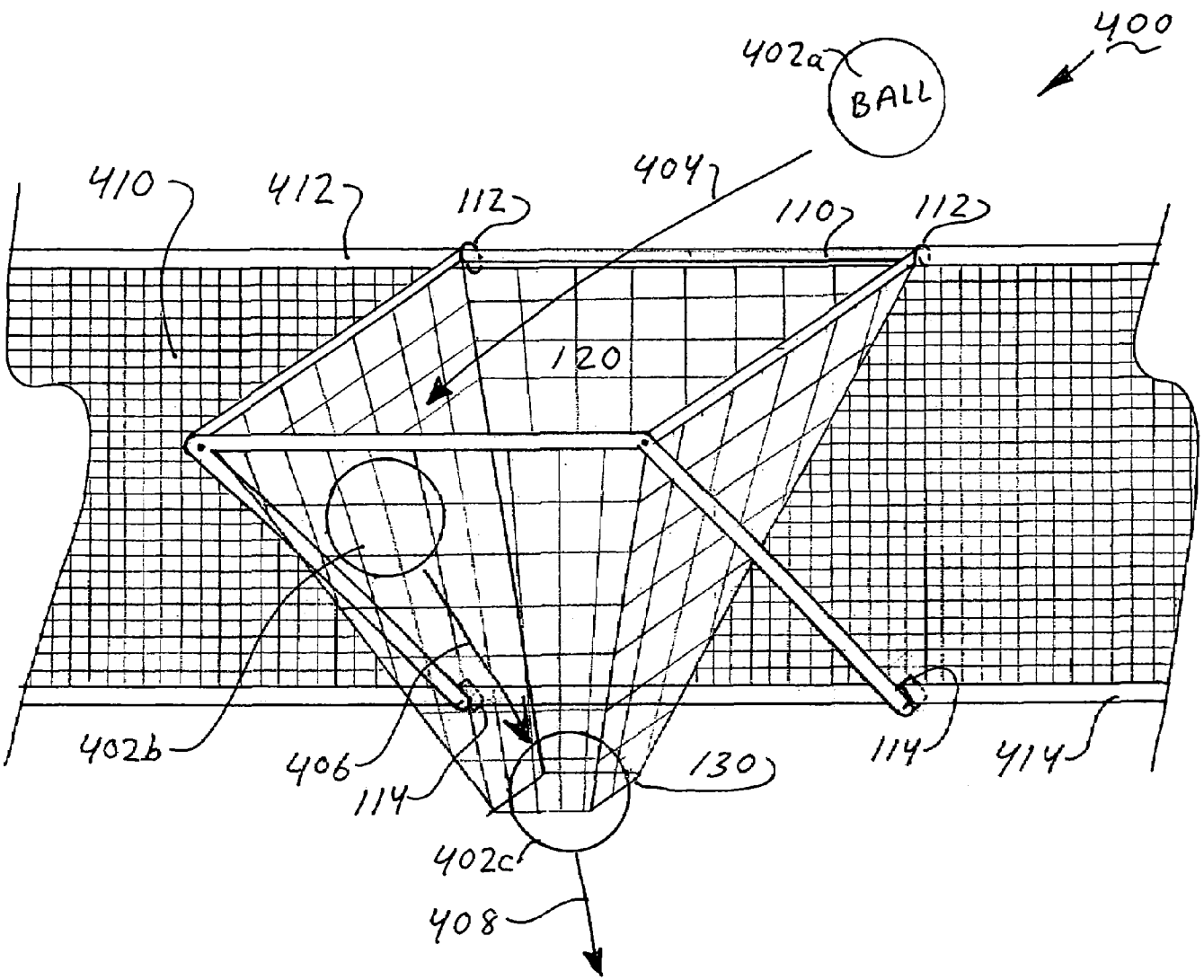
FIG. 4 illustrates an embodiment of the invention mounted on a court net.

FIG. 4 illustrates generally at 400, an embodiment of the invention mounted on a court net. With reference to FIG. 4, the top edge of the surface 110 is coupled with a court net 410 along the upper edge of the court net 412 using clips 112. The bottom of the court net 414 is coupled with the frame using clips or similar structures at 114. A ball 402*a* is aimed by a player (not shown) and approaches the upper opening 120 of the target. Successful aiming by the player results in the ball traveling from position 402*a* to position 402*b* and eventually passing out of the lower opening 130 as shown at position 402*c* by path 408. The surface can employ the cup area as previously described in conjunction with FIG. 2C to assist in settling the ball; thereby facilitating a mostly vertical vector 408, representing the travel path of the ball as the ball exits the target.

Figure 5:
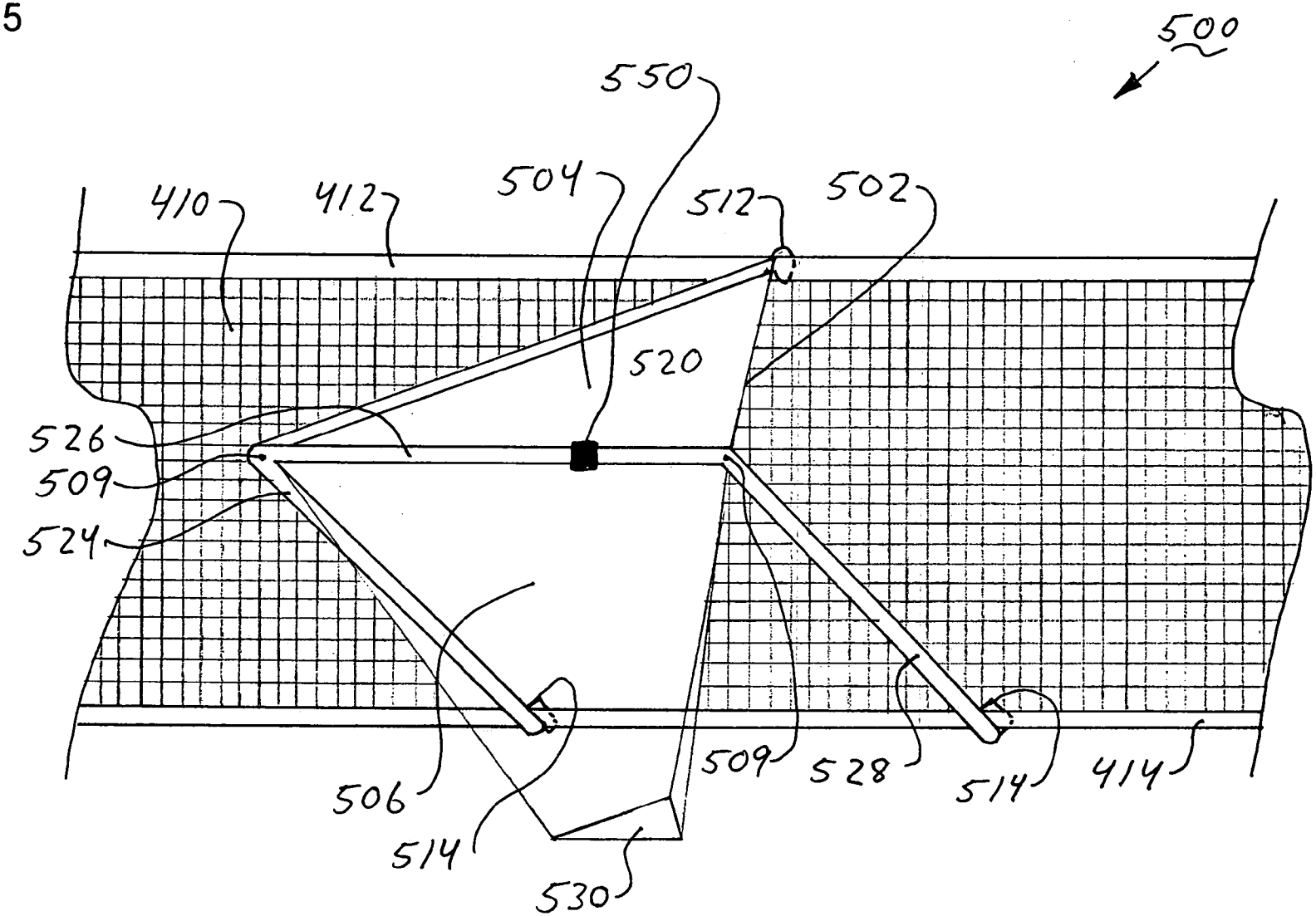
FIG. 5 illustrates another embodiment of the invention utilizing a triangular target area.

The upper opening and lower opening of the target can be fashioned into different shapes. The present invention is not limited by the shape of the openings. Several examples of alternative shapes for the openings are described below in conjunction with FIG. 5, FIG. 6, and FIG. 7. FIG. 5 illustrates another embodiment of the invention utilizing a triangular target area, shown generally at 500. With reference to FIG. 5, a surface 504 encloses a volume defining a target having an upper opening 520. Players, as previously described, aim an object (such as a ball, a shuttlecock, etc.) at the opening 520 to practice various aspects of games such as volleyball, tennis or badminton. Upon a successful pass, an object (not shown) would enter the upper opening 520 and then pass out of the lower opening 530. A catch basket (not shown) can be placed under the lower opening 530 to receive the object. A frame 524, 526, and 528 is removably attachable to the bottom of the court net 414 by means of clips 514 or other structures that perform a similar function. Hinges 509 permit frame 524 and 528 to fold and become substantially parallel to frame 526; thereby allowing the volume of the target to be reduced (collapsed) for storage. In various embodiments, the frame can be folded and then rolled up with the surface, collapsing the surface; thus, allowing the target to be stored in a minimum amount of space when not in use.

The surface 504 is removably attachable to the court net with a clip 512 or other removable attachments, such as but not limited to, straps, flaps, sleeves, hook and loop (VELCRO®), etc. Generally, the surface will be attached to the top 412 of the court net 410; however, other placements are possible, according to various embodiments of the invention. Frame 526 can be adjustable in length, thereby permitting the shape of the upper opening 520 to be varied. In one or more embodiments, frame 526 can be divided into a left and right portion that fit within each other in a telescoping way. One end of a portion of frame 526 can be threaded to receive a friction clamp 550. Friction clamp 550 can be used to reduce the inside diameter of the threaded portion of frame 526 which in turn will compress and lock the other portion of frame 526 in place. Other methods of adjusting the length of frame 526 are possible such as the pushbutton mechanism described in conjunction with previous figures.

The surface 504 is illustrated as transparent within FIG. 5; however no limitation is implied thereby. The surface 504, as in all instances within this description in which structures are used to depict the surface, can be made out of many different materials, such as mesh netting, films such as Mylar®, woven materials utilizing nylon, cotton, etc.

Figure 6:
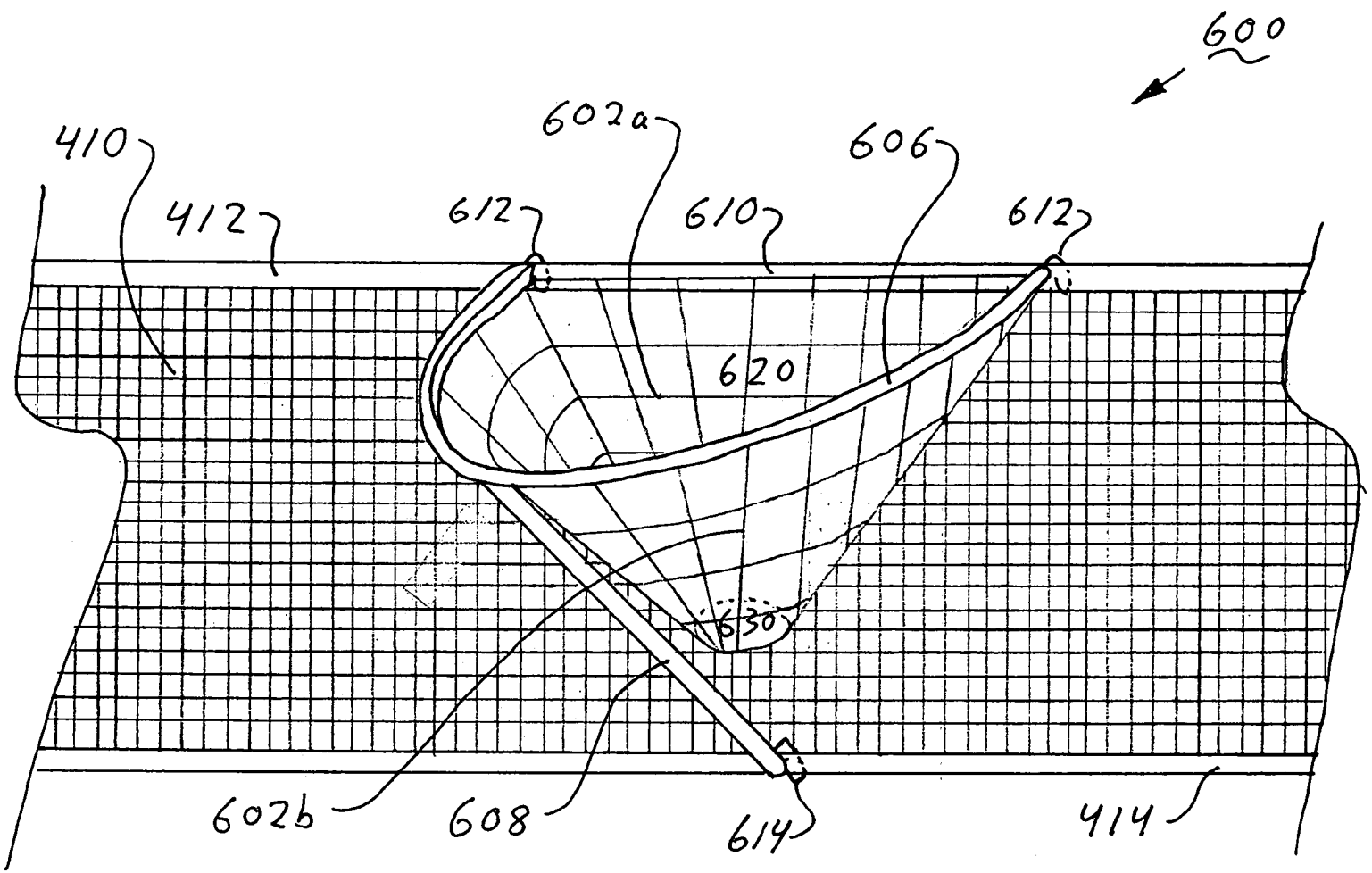
FIG. 6 illustrates a semicircular target area, according to one embodiment of the invention.

FIG. 6 illustrates a semicircular target area, according to one embodiment of the invention, shown generally at 600. With reference to FIG. 6, a surface having sides 602*a* and 602*b* encloses a volume having an upper opening 620 and a lower opening 630. The surface has a top edge 610, attached to the top of a court net 412 with clips 612. Opening 620 is semicircular and is formed with frame 606 coupled to the surface. Frame 606 is coupled to frame 608. The lower end of frame 608 is removably attached to the bottom of the court net 414 with a clip 614. Various structures can be used to attach frame 608 to the court net, such as a clip 614. Alternatively, straps, hooks, etc. can be used to attach fame 608 to the court net.

The upper and lower openings need not be confined to be the same shape within a given embodiment of the invention. For example, in FIG. 6 the upper opening is semicircular and the lower opening is circular or elliptical. Likewise in FIG. 5, the upper opening is triangular; however, the lower opening can be a shape other than the triangular shape shown in the figure.

With reference back to FIG. 6, the surface (602*a* and 602*b*) can be coupled to the frame 606 in various ways. For example, the surface can be attached to the frame 606 with the hooks and grommets described in conjunction with FIG. 1B. Another example of coupling uses a sleeve along the top of the surface into which the frame 606 slides.

The frame 606 as well as in all instances within this description where reference is made to the frame, can be made of wood or metal such as aluminum, stainless steel, titanium or other materials such as fiber reinforced resin. Some examples of resin and fibers are, but are not limited to, polyester or epoxy resin and fibers such as polyester fiber, carbon fiber, Kevlar® fiber, etc. As is known by those of ordinary skill in the art, the frame 606 can also be made out of rubber or plastic or various composite constructions and can be designed to absorb high impact from ball strikes as desired for the particular game in which the target is employed.

The cross-sectional area of the opening 620 can be adjusted using the techniques previously described in conjunction with the previous figures. Frame 606 can be made with a telescoping construction incorporating push button locking, friction locking, etc. to secure multiple section of the frame 606 together. Alternatively, or in addition to an adjustable frame 606, the location of the attachment points of the surface coinciding with clips 612 can be either spaced apart or spaced together on the court net 410 to change the shape of the upper opening 620.

Figure 7:
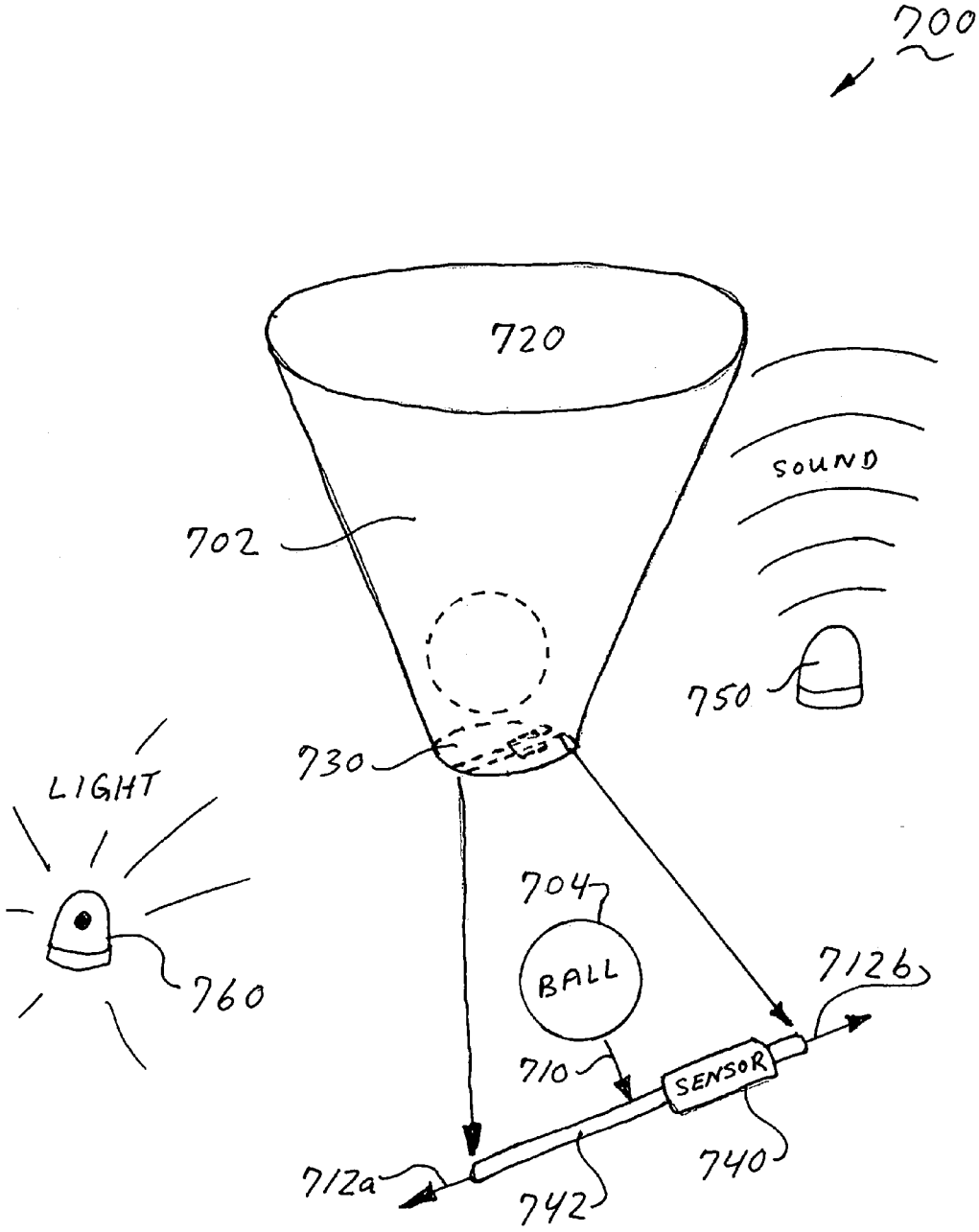
FIG. 7 illustrates an example of a target alarm according to one embodiment of the invention.

As players aim for the upper openings presented by the targets described herein, an object, such as a ball in some embodiments, will at various times enter the upper opening and exit the lower opening and at other times the ball will bounce off the top edge of the upper opening. It may be desirable to provide the player with an indication that the ball entered the upper opening and exited the lower opening as was intended. FIG. 7 illustrates an example of a target alarm according to one embodiment of the invention, shown generally at 700. With reference to FIG. 7, a surface 702 encloses a volume having an upper opening 720 and a lower opening 730. A ball, aimed by a player (not shown) enters the upper opening 720 passing into the volume (indicated by dashed lines) and then passes out of the lower opening 730.

A sensor 740 is configured to detect the presence of the ball 704 proximate to the lower opening. In one embodiment, the ball 704 contacts (indicated by 710) a flexible member 742 causing a sensor 740 to register the presence of the ball 704. Sensor 740 can communicate with an alarm 750 or 760 which in turn transmits a signal observable to a player that the ball has passed out of the volume enclosed by surface 702.

Balls used in a given sport may be of a uniform size. Therefore, in one embodiment the cross-sectional area of the lower opening on either side of the member 742 is sized to permit the ball to pass through while providing sufficient loading to trigger the sensor. Many different kinds of sensors are suitable for use as sensor 740. For example, a spring operated sensor can be configured to electrically energize the alarm when loaded axially as indicated by loading 712*a*/712*b*. Several ounces of additional axial load, imparted to the flexible member 742, by a volleyball passing through one half of the lower opening 730 will produce a sufficient load on the sensor 740 in order to differentiate the presence of the ball from motion induced when a ball strike deflects off the target and does not pass through the lower opening 130. In one embodiment, the sensor 740 functions as a switch to trigger alarm 750 or alarm 760. Flexible member 742 can be made of light weight nylon line or other suitable material.

Polyvinylidene Fluoride (PVDF) available from AMP Sensor, Inc. can be used as a sensor material. As is known to those of ordinary skill in the art, PVDF film can be connected to a simple op-amp network which generates an output when the PVDF is stressed due to contact between the ball 704 and a mechanical attachment to the PVDF or a structure in contact with the PVDF element. The op-amp output drives a MOSFET to allow interfacing to control electronics that activates the alarm 750 or 760. Various wired or wireless connections are possible between the sensor 740 and the alarm 750 or 760. A wireless transmitter can be incorporated with the sensor at 740 to communicate with a suitable receiver located at 750 or 760. The PVDF film can be configured to be loaded in tension or bent when mounted in a cantilevered fashion when the load (712*a*/712*b*) on member 742 reaches a preset value. The preset value can be set by selecting a spring of a specific stiffness that allows sufficient deflection during the passage of the volleyball through the opening 730.

Those of ordinary skill in the art will appreciate that other types of sensors can be employed within the scope of the teachings herein. For example, a proximity sensor can be mounted on the bottom edge of the surface 702 in the vicinity of the lower opening. Such a proximity sensor would be triggered by the presence of the ball passing into the lower opening and function as described above, ultimately communicating with and causing the alarm 750 or 760 to emit a signal that is observable to a player.

In one embodiment, alarm 760 is emits an audible signal which a player can hear. Such an audible signal can be in the form of a bell sound, a buzzer sound, or a whistle. Alternatively, in other embodiments, the alarm 760 can emit a visual signal such as light. The light can be a light that stays lit for a predetermined period of time, a blinking light, an illuminated letter, an illuminated number or a collection of illuminated letters or numbers or a combination thereof. In other embodiments, a combination of signals can be triggered by the sensor which includes audible and visual signals. Other visual signals can include motion producing devices, such as a spinning pinwheel.

It will be appreciated that the methods described in conjunction with the figures may be embodied in machine-executable instructions, e.g. software. The instructions can be used to cause a general-purpose or special-purpose processor that is programmed with the instructions to perform the operations described. Alternatively, the operations might be performed by specific hardware components that contain hardwired logic for performing the operations, or by any combination of programmed computer components and custom hardware components. The methods may be provided as a computer program product that may include a machine-readable medium having stored thereon instructions which may be used to program a computer (or other electronic devices) to perform the methods. For the purposes of this specification, the term "machine-readable medium" shall be taken to include any medium that is capable of storing or encoding a sequence of instructions for execution by the machine and that cause the machine to perform any one of the methodologies of the present invention. The term "machine-readable medium" shall, accordingly, be taken to include, but not be limited to, solid-state memories, optical and magnetic disks, and carrier wave signals. Furthermore, it is common in the art to speak of software, in one form or another (e.g., program, procedure, process, application, module, logic . . . ), as taking an action or causing a result. Such expressions are merely a shorthand way of saying that execution of the software by a computer causes the processor of the computer to perform an action or produce a result.

As used in this description, "one embodiment," "one or more embodiments," "an embodiment" or similar phrases mean that feature(s) being described are included in at least one embodiment of the invention. References to "one embodiment" or any reference to an embodiment in this description do not necessarily refer to the same embodiment; however, neither are such embodiments mutually exclusive. Nor does "one embodiment" imply that there is but a single embodiment of the invention. For example, a feature, structure, act, etc. described in "one embodiment" may also be included in other embodiments. Thus, the invention may include a variety of combinations and/or integrations of the embodiments described herein.

While the invention has been described in terms of several embodiments, those of ordinary skill in the art will recognize that the invention is not limited to the embodiments described, but can be practiced with modification and alteration within the spirit and scope of the appended claims. The description is thus to be regarded as illustrative instead of limiting.

What is claimed is:

1. An apparatus comprising:

a surface configured to enclose a first volume having an upper opening and a lower opening, wherein the surface is removably attachable to a court net; and a frame coupled with the surface, wherein the frame is removably attachable to the court net, such that an object can be aimed by a player to enter the upper opening and pass through the lower opening, wherein the surface is made out of a material selected from the group consisting of flexible net material, plastic film and cloth, wherein a cup area is formed in the surface near the lower opening.

2. The apparatus of claim 1, wherein the court net is a volleyball net.

3. The apparatus of claim 1, wherein the object is a ball.

4. The apparatus of claim 1, wherein the object is a shuttlecock.

5. The apparatus of claim 1, wherein an edge of the upper opening is a color that is different from the rest of the surface.

6. The apparatus of claim 5, wherein the color of the upper opening is selected from the group consisting of black, red, orange, a fluorescent color and yellow.

7. An apparatus comprising:

a surface configured to enclose a first volume having an upper opening and a lower opening, wherein the surface is removably attachable to a court net; and a frame coupled with the surface, wherein the frame is removably attachable to the court net, such that an object can be aimed by a player to enter the upper opening and pass through the lower opening wherein a cross-sectional area of the upper opening is adjustable and the cross-sectional area of the upper opening can be adjusted by changing a length of the frame.

8. The apparatus of claim 7, wherein the court net is a volleyball net.

9. The apparatus of claim 7, wherein the object is a ball.

10. The apparatus of claim 7, wherein the object is a shuttlecock.

11. The apparatus of claim 7, wherein an edge of the upper opening is a color that is different from the rest of the surface.

12. The apparatus of claim 11, wherein the color of the upper opening is selected from the group consisting of black, red, orange, a fluorescent color and yellow.

13. The apparatus of claim 7, further comprising:

a signal means in communication with the lower opening configured to generate a signal observable to the player when the object is proximate to the lower opening.

14. The apparatus of claim 13, wherein the signal is an audio signal.

15. The apparatus of claim 14, wherein the audio signal is selected from the group consisting of a bell sound, a buzzer sound and a whistle sound.

16. The apparatus of claim 13, wherein the signal is a visual signal.

17. The apparatus of claim 16, wherein the visual signal is selected from the group consisting of a light, a blinking light, an illuminated number and an illuminated letter.

18. The apparatus of claim 7, further comprising:

a sensor configured to detect the presence of the object proximate to the lower opening, and an alarm responsive to the sensor, such that when the object is proximate to the lower opening the alarm emits a signal observable to the player.

19. An apparatus comprising:

a surface configured to enclose a first volume having an upper opening and a lower opening, wherein the surface is removably attachable to a court net; and a frame coupled with the surface, wherein the frame is removably attachable to the court net, such that an object can be aimed by a player to enter the upper opening and pass through the lower opening wherein a cross-sectional area of the upper opening is adjustable and the cross-sectional area of the upper opening can be adjusted by gathering a part of the surface.

20. The apparatus of claim 19, wherein the court net is a volleyball net.

21. The apparatus of claim 19, wherein the object is a ball.

22. The apparatus of claim 19, wherein the object is a shuttlecock.

23. The apparatus of claim 19, wherein an edge of the upper opening is a color that is different from the rest of the surface.

24. The apparatus of claim 23, wherein the color of the upper opening is selected from the group consisting of black, red, orange, a fluorescent color and yellow.

25. The apparatus of claim 19, further comprising:

a signal means in communication with the lower opening configured to generate a signal observable to the player when the object is proximate to the lower opening.

26. The apparatus of claim 25, wherein the signal is an audio signal.

27. The apparatus of claim 26, wherein the audio signal is selected from the group consisting of a bell sound, a buzzer sound and a whistle sound.

28. The apparatus of claim 25, wherein the signal is a visual signal.

29. The apparatus of claim 28, wherein the visual signal is selected from the group consisting of a light, a blinking light, an illuminated number and an illuminated letter.

30. The apparatus of claim 19, further comprising:

a sensor configured to detect the presence of the object proximate to the lower opening, and an alarm responsive to the sensor, such that when the object is proximate to the lower opening the alarm emits a signal observable to the player.

31. An apparatus comprising:

a surface configured to enclose a first volume having an adjustable upper opening and having a lower opening, wherein the surface is removably attachable to a court net; and a frame coupled with the surface, wherein the frame is removably attachable to the court net, such that a ball can be aimed by a player to enter the upper opening and pass through the lower opening and a cup area is formed in the surface near the lower opening.

32. The apparatus of claim 31, wherein the court net is a volleyball net.

33. The apparatus of claim 31, wherein an edge of the upper opening is colored differently from the rest of the surface.

34. The apparatus of claim 31, further comprising:

a sensor configured to detect the presence of the ball proximate to the lower opening; and an alarm responsive to the sensor, such that when the ball is proximate to the lower opening the alarm emits a signal observable to a human.

35. The apparatus of claim 31, the frame further comprising:

a plurality of members flexibly coupled together, to allow the surface to collapse, such that the apparatus can occupy a second volume when collapsed and the second volume is smaller than the first volume.

* * * * *